US005557312A

United States Patent [19]

Sago

[11] Patent Number: 5,557,312

[45] Date of Patent: Sep. 17, 1996

[54] THERMAL RECORDING AND ERASING APPARATUS

[75] Inventor: Akira Sago, Nagoya, Japan

[73] Assignee: Brother Kogyo Kabushiki Kaisha, Nagoya, Japan

[21] Appl. No.: 154,524

[22] Filed: Nov. 19, 1993

[30] Foreign Application Priority Data

Dec. 3, 1992 [JP] Japan ..... 4-324274
Dec. 24, 1992 [JP] Japan ..... 4-344353

[51] Int. Cl.[6] ..... B41J 29/36; B41J 2/32; B41J 2/36

[52] U.S. Cl. ..... 347/171; 347/188

[58] Field of Search ..... 347/171, 188, 347/193; 400/120.13, 120.09, 120.01

[56] References Cited

U.S. PATENT DOCUMENTS 5,231,505 7/1993 Watanabe et al. .

FOREIGN PATENT DOCUMENTS 56-086777 7/1981 Japan ..... 347/171
57-89993 6/1982 Japan .
63-39377 2/1988 Japan .

*Primary Examiner*—Huan H. Tran
*Attorney, Agent, or Firm*—Oliff & Berridge

[57] ABSTRACT

A recording apparatus for recording images on a heat-sensitive sheet, including an image-erasing device which thermally erases images recorded on a first heat-sensitive sheet which is a recyclable heat-sensitive sheet, thereby recycling the first sheet; an image-recording device which thermally records images on each of (a) the first sheet which has been recycled by the image-erasing device and (b) (b1) a second heat-sensitive sheet which is a recyclable heat-sensitive sheet and which has not been recycled by the image-erasing device and/or (b2) a third heat-sensitive sheet which is an unrecyclable heat-sensitive sheet; and a control device which controls the image-recording device according to a first recording condition when the image-recording device records images on the first sheet recycled by the image-erasing device, controls the image-recording device according to a second recording condition different from the first recording condition when the image-recording device records images on the second sheet, and controls the image-recording device according to a third recording condition different from the first recording condition when the image-recording device records images on the third sheet.

23 Claims, 6 Drawing Sheets

THERMAL RECORDING AND ERASING APPARATUS

BACKGROUND OF THE INVENTION

1. Field of the Invention

The present invention relates to a recording apparatus including an image-erasing device which thermally erases images recorded on a recyclable heat-sensitive sheet and an image-recording device which thermally records images on a recyclable and/or an unrecyclable heat-sensitive sheet.

2. Related Art Statement

There is known a reusable or recyclable heat-sensitive sheet (hereinafter, referred to as the "recycle" sheet) on which images are recorded by heating to a first prescribed temperature and from which the images recorded thereon are erased by heating to a second prescribed temperature higher than the first temperature. This sheet can be recycled many times. Various sorts of recycle sheets are disclosed in Publications No. 57-89993 and No. 63-39377 of unexamined Japanese Patent Applications and U.S. Pat. No. 5,231,505. Meanwhile, there has been known an unrecyclable heat-sensitive sheet (hereinafter, referred to as the "non-recycle" sheet) on which images are recorded by heating to a first temperature but from which the images recorded thereon are not erased by heating to a second temperature higher than the first temperature.

There has been proposed a recording apparatus including (a) an image-erasing device which thermally erases images recorded on a recycle sheet and (b) an image-recording device which thermally records images on a recycle or non-recycle sheet. The recording apparatus additionally includes, as shown in FIG. 7, a sheet cassette 200, and a sheet feed roller 201 for taking out the top one of recycle or non-recycle sheets 202 stacked in the cassette 200 and feeding the thus taken-out sheet 202 toward a first pair of sheet-guide members 207.

In a first case where the sheets 202 stacked in the cassette 200 include only imaged recycle sheets 202*a* each of which is a recycle sheet with images recorded thereon, the images on each recycle sheet 202*a* are erased by the image-erasing device before new, desired images are recorded on the thus recycled sheet 202*a* by the image-recording device. In this case, a nipper roller 203*a* which cooperates with a heater roller 203*b* to serve as the image-erasing device, is placed at a position, A, indicated in solid lines, so that the two rollers 203*a*, 203*b* nips the imaged recycle sheet 202*a* and convey the sheet 202*a* toward a second pair of sheet-guide members 204 while the heater roller 203*b* heats the imaged sheet 202*a* for erasing the images thereon. Meanwhile, in a second case where the sheets 202 stacked in the cassette 200 include only image-free recycle sheets 202*a* each of which is a recycle sheet without any images thereon, desired images are recorded on each recycle sheet 202*a* by the image-recording device without previous image erasing by the image-erasing device. In the second case, the nipper roller 203*a* is placed at a position, B, indicated in two-dot chain lines, so that the two rollers 203*a*, 203*b* do not nip the recycle sheet 202*a* so as to permit the sheet 202*a* to be conveyed toward the second sheet-guide members 204. Thus, the heater roller 203*b* does not heat the recycle sheet 202*a*. In either case, when the recycled or image-free recycle sheet 202*a* reaches a platen 205, a recording head 206 thermally records desired images on the recycle sheet 202*a* and thereafter the thus imaged sheet 202*a* is outputted from the recording apparatus.

In the above-described first case, however, the time duration from the previous image erasing on an imaged recycle sheet 202*a* to the subsequent image recording on the recycled sheet 202*a* is very short, and thus the stability of image-developing function of the recycle sheet 202*a* is considerably low at the time of the image recording. On the other hand, in the second case where images are recorded on an image-free recycle sheet 202*a* without previous image erasing, the stability of image-developing function of the recycle sheet 202*a* is considerably high at the time of the image recording because the recycle sheet 202*a* has not been heated by the image-erasing device immediately before the image recording. Therefore, for the first and second cases, the recording head 206 of the image-recording device should be supplied with different drive energies for effecting the image recording with sufficiently high recording quality. However, the above recording apparatus supplies a constant or common drive energy to the image-recording device for the two different cases. Consequently the image recording is carried out with excessively high or low amount of drive energy and therefore well-defined or clear images are not obtained.

In a third case with the above recording apparatus where the sheets 202 stacked in the cassette 200 include only non-recycle sheets 202*b*, images are recorded on each non-recycle sheet 202*b* in such a manner that the nipper roller 203*a* is placed at the position B so that the two rollers 203*a*, 203*b* do not nip the non-recycle sheet 202*b* for permitting the sheet 202*b* to be conveyed toward the second sheet-guide members 204. In this case, therefore, the heater roller 203*b* does not positively heat the non-recycle sheet 202*b*. However, a common path is used for conveying both the recycle and non-recycle sheets 202*a*, 202*b*, and the heater roller 203*b* of the image-erasing device is heated to an image-erasing temperature (e.g., about 150° C.) higher than an image-developing temperature (e.g., about 60° C.) of the non-recycle sheets 202*b*. Thus, in the recording apparatus, the temperature of the image-erasing device (or heater roller 203*b*) must decrease to a temperature lower than the image-developing temperature of the non-recycle sheets 202*b*, before each non-recycle sheet 202*b* passes through the image-erasing device. In other words, the recording apparatus needs an additional cooling time in the case where images are recorded on a non-recycle sheet 202*b* immediately after images have been recorded on a recycle sheet 202*a*. If this cooling time is not taken, well-defined or clear images are not recorded on the sheet 202*b*, that is, recording quality is lowered. The non-recycle sheet 202*b* may even be "burned" partly or entirely by the heater 203*b*.

SUMMARY OF THE INVENTION

It is therefore an object of the present invention to provide a recording apparatus which appropriately regulates thermal energy applied to a heat-sensitive recording medium and records images on the medium with improved recording quality.

The above object has been achieved by the present invention. According to a first aspect of the present invention, there is provided a recording apparatus for recording images on a recyclable heat-sensitive sheet, comprising an image-erasing device which thermally erases images recorded on a first recyclable heat-sensitive sheet, thereby recycling the first sheet, an image-recording device which thermally records images on each of (a) the first sheet which has been recycled by the image-erasing device and (b) a second recyclable heat-sensitive sheet which has not been recycled by the image-erasing device, and a control device which supplies a first energy to the image-recording device when the image-recording device records images on the first sheet recycled by the image-erasing device, and supplies a second energy different from the first energy to the image-recording device when the image-recording device records images on the second sheet.

In the recording apparatus constructed as described above, the control device supplies a first energy to the image-recording device when the image-recording device records images on the first sheet recycled by the image-erasing device, and supplies a second energy different from the first energy to the image-recording device when the image-recording device records images on the second sheet which has not been subjected to the image erasing or sheet recycling by the image-erasing device. Thus, the present recording apparatus appropriately regulates the drive energy supplied to the image-recording device, accordingly, the thermal energy applied to the first or second recyclable ("recycle") sheet, thereby improving the image recording quality. Additionally, the present apparatus effectively reduces energy consumption.

In a preferred embodiment according to the first aspect of the present invention, the control device supplies the first energy higher than the second energy to the image-recording device when the image-recording device records images on the first sheet recycled by the image-erasing device.

According to a second aspect of the present invention, there is provided a recording apparatus for recording images on a recyclable heat-sensitive sheet and an unrecyclable heat-sensitive sheet, comprising an image-erasing device which thermally erases images recorded on a recyclable heat-sensitive sheet, thereby recycling the recyclable sheet, the image-erasing device comprising a heat-generating member for heating the recyclable sheet; an image-recording device which thermally records images on each of (a) the recyclable sheet which has been recycled by the image-erasing device and (b) an unrecyclable heat-sensitive sheet, the image-recording device comprising a heat-insulating member, the heat-generating and heat-insulating members taking a first relative-positional relationship wherein the heat-generating and heat-insulating members are positioned relatively away from each other so as to permit the heat-generating member to heat the recyclable sheet and thereby recycle the recyclable sheet, and a second relative-positional relationship wherein the heat-insulating member is positioned between the heat-generating member and the unrecyclable sheet so as to prevent the heat-generating member from heating the unrecyclable sheet; and a control device which controls at least one of the heat-generating and heat-insulating members to take the first relative-positional relationship when the image-recording device records images on the recyclable sheet recycled by the image-erasing device, and controls at least one of the heat-generating and heat-insulating members to take the second relative-positional relationship when the image-recording device records images on the unrecyclable sheet.

In the recording apparatus constructed as described above, the control device controls the heat-generating and/or heat-insulating member to take the first relative-positional relationship so as to permit the heat-generating member to heat the recyclable sheet and thereby recycle the recyclable sheet, when the image-recording device records images on the recyclable sheet recycled by the image-erasing device, while the control device controls the heat-generating and/or heat-insulating member to take the second relative-positional relationship so as to prevent the heat-generating member from heating the unrecyclable sheet, when the image-recording device records images on the unrecyclable sheet. Thus, the present recording apparatus appropriately regulates the thermal energy applied to the recyclable ("recycle") or unrecyclable ("non-recycle") sheet, thereby improving the image recording quality. Additionally, the present apparatus is capable of recording images on each of recycle and non-recycle sheets in a continuous manner, i.e., without needing any cooling period at the time when recycle sheets are switched to non-recycle sheets.

In a preferred embodiment according to the second aspect of the present invention, the recording apparatus further comprises a sheet feeding device which feeds the recyclable sheet to the image-erasing device and subsequently to the image-recording device, and feeds the unrecyclable sheet to the image-recording device, and a sheet identifying device which identifies whether a heat-sensitive sheet fed by the sheet feeding device is the recyclable sheet or the unrecyclable sheet, when the sheet identifying device identifies that the heat-sensitive sheet fed by the sheet feeding device is the recyclable sheet, the control device controls at least one of the heat-generating and heat-insulating members to take the first relative-positional relationship, when the sheet identifying device identifies that the heat-sensitive sheet fed by the sheet feeding device is the unrecyclable sheet, the control device controls at least one of the heat-generating and heat-insulating members to take the second relative-positional relationship.

According to a third aspect of the present invention, there is provided a recording apparatus for recording images on a heat-sensitive sheet, comprising an image-erasing device which thermally erases images recorded on a recyclable heat-sensitive sheet, thereby recycling the recyclable sheet, the image-erasing device comprising a heat-generating member for heating the recyclable sheet; an image-recording device which thermally records images on each of (a) the recyclable sheet which has been recycled by the image-erasing device and (b) an image-free heat-sensitive sheet which does not need the image erasing by the image-erasing device, the image-recording device comprising a heat-insulating member, the heat-generating and heat-insulating members taking a first relative-positional relationship wherein the heat-generating member and heat-insulating members are positioned relatively away from each other so as to permit the heat-generating member to heat the recyclable sheet and thereby recycle the recyclable sheet, and a second relative-positional relationship wherein the heat-insulating member is positioned between the heat-generating member and the image-free sheet so as to prevent the heat-generating member from heating the image-free sheet; and a control device which, when the image-recording device records images on the recyclable sheet recycled by the image-erasing device, controls at least one of the heat-generating and heat-insulating members to take the first relative-positional relationship and simultaneously supplies a first energy to the image-recording device and, when the image-recording device records images on the image-free sheet, controls at least one of the heat-generating and heat-insulating members to take the second relative-positional relationship and simultaneously supplies a second energy different from the first energy to the image-recording device. The image-free sheet may be either a recycle or non-recycle sheet each with no image thereon. The present recording apparatus provides various advantages obtained by combining the advantages with the above-described two recording apparatus according to the first and second aspects of the present invention.

According to a fourth aspect of the present invention, there is provided a recording apparatus for recording images on a heat-sensitive sheet, comprising an image-erasing device which thermally erases images recorded on a first heat-sensitive sheet which is a recyclable heat-sensitive sheet, thereby recycling the first sheet; an image-recording device which thermally records images on each of (a) the first sheet which has been recycled by the image-erasing device and (b) at least one of (b1) a second heat-sensitive sheet which is a recyclable heat-sensitive sheet and which has not been recycled by the image-erasing device and (b2) a third heat-sensitive sheet which is an unrecyclable heat-sensitive sheet; and a control device which controls the image-recording device according to a first recording condition when the image-recording device records images on the first sheet recycled by the image-erasing device, controls the image-recording device according to a second recording condition different from the first recording condition when the image-recording device records images on the second sheet, and controls the image-recording device according to a third recording condition different from the first recording condition when the image-recording device records images on the third sheet. The control device may be adapted to control the image-recording device according to a common recording condition as the second and third recording conditions when the image-recording device records images on each of the second and third sheets. The present recording apparatus appropriately regulates thermal energy applied to each sort of heat-sensitive recording medium and thereby records images on each medium with satisfactory recording quality.

BRIEF DESCRIPTION OF THE DRAWINGS

The above and optional objects, features, and advantages of the present invention will be better understood by reading the following detailed description of the presently preferred embodiments of the invention when considered in conjunction with the accompanying drawings, in which.

DETAILED DESCRIPTION OF THE PREFERRED EMBODIMENTS

Figure 1:
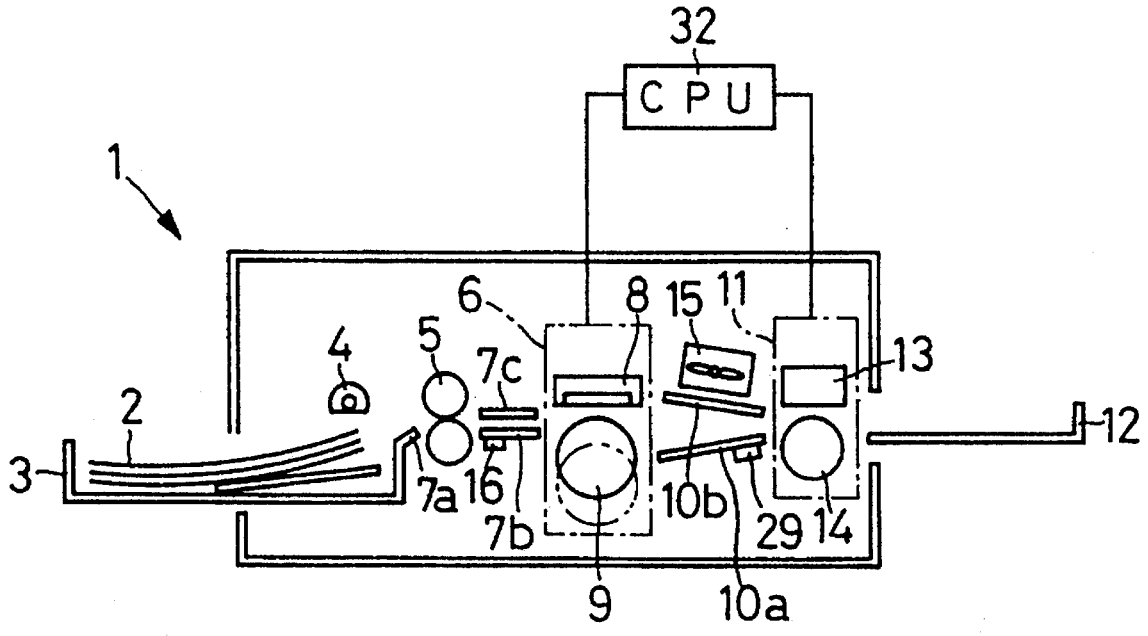
FIG. 1 is a diagrammatic view of a recording apparatus embodying the present invention, showing the cross section through the middle portion thereof.

Referring first to FIG. 1, there is shown a printer 1 as a recording apparatus embodying the present invention.

At the left-hand and lower-half portion of the printer 1 shown in cross section in FIG. 1, there is provided a sheet cassette 3 in which a plurality of recyclable heat-sensitive image-recording cut sheets 2 (hereinafter, referred to as the "recycle sheets 2") are accommodated. The sheet cassette 3 is removable frontward (i.e., leftward in FIG. 1) from the printer 1. Thus, the sheet cassette 3 serves as an inlet of the printer 1. Above the right-hand end of the sheet cassette 3 being set in the printer 1, there is provided a generally semi-lunar sheet-feed roller 4 which is rotatable for taking out the top one of the recycle sheets 2 stacked in the sheet cassette 3 and feeding the taken-out recycle sheet 2 toward a sheet-convey roller 5. A first sheet chute *7a* is provided between the feed roller 4 and the convey roller 5, and a second and a third sheet chute *7b, 7c* are provided between the convey roller 5 and an image-erasing device 6. The first to third sheet chutes *7a, 7b, 7c* serve as sheet-guide members for providing a path along which the recycle sheet 2 is conveyed forward. A first sheet sensor 16 is fixed to the second sheet chute *7b*. The first sheet sensor 16 detects the leading or top edge of the recycle sheet 2 being conveyed by the convey roller 5, and generates a detection signal indicative of the detection of the recycle sheet 2.

The image-erasing device 6 is located on the downstream or right-hand side of the sheet convey roller 5 as viewed in the direction of conveying of the recycle sheet 2. The image-erasing device 6 includes a sheet heater 8, and a silicone-based movable roller 9 located below the sheet heater 8. The movable roller 9 is movable between a first position (indicated in solid lines in FIG. 1) where the roller 9 cooperates with the sheet heater 8 to nip the recycle sheet 2 therebetween, and a second position (indicated in two-dot chain lines) where the roller 9 is away from the sheet heater 8. Downstream of the image-erasing device 6, there are provided a fourth and a fifth sheet chute *10a, 10b*, an image-recording device 11, and an output tray 12 in the order of description. The image-recording device 11 includes a thermal recording head 13 including a number of heat-generating elements (not shown), and a platen 14 located below the recording head 13, both of which serve for recording desired images on the recycle sheet 2. An electric fan 15 is disposed above the fifth chute *10b*. The electric fan 15 directs air toward the fifth chute *10b*, thereby indirectly cooling the recycle sheet 2 which currently is being conveyed below the fifth chute *10b* after having been heated by the image-erasing device 6 or sheet heater 8. A second sheet sensor 29 is fixed to the fourth chute *10a*. The second sheet sensor 29 detects the top edge of the recycle sheet 2 being conveyed, and generates a detection signal indicative of the detection of the recycle sheet 2.

Figure 2:
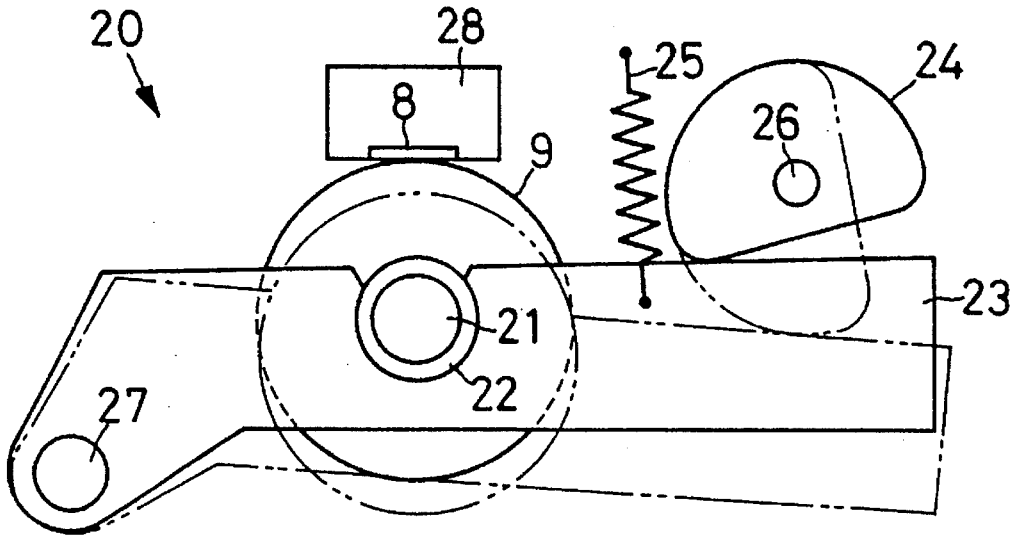
FIG. 2 is an illustrative view of an image-erasing device of the recording apparatus of FIG. 1.
Figure 3:
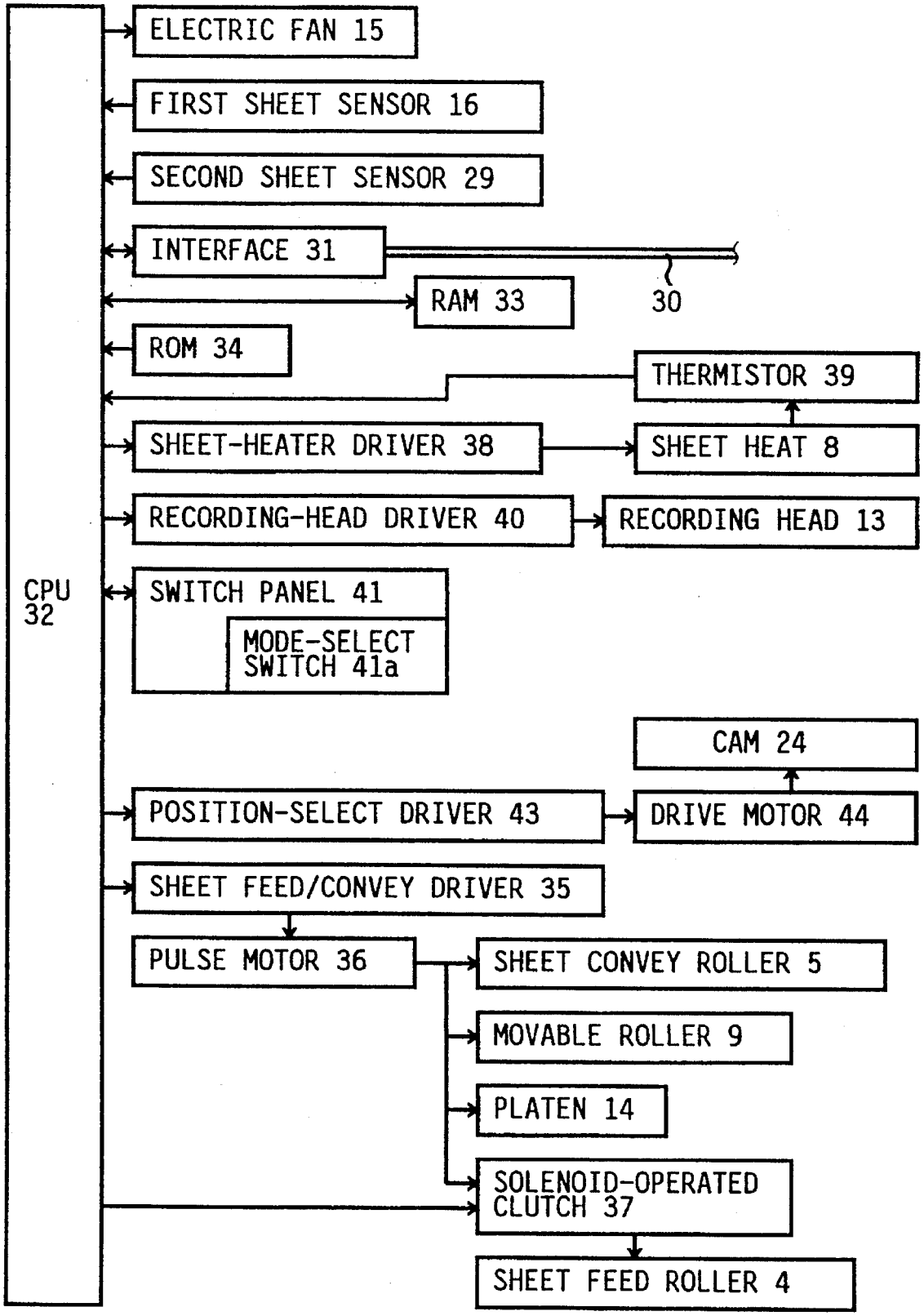
FIG. 3 is a block diagram of the electric circuit of the recording apparatus of FIG. 1.

As shown in FIG. 2, the image-erasing device 6 additionally includes a roller-release mechanism 20. The roller-release mechanism 20 includes a roller-release lever 23 on which an axis member 21 of the movable roller 9 rests via a bearing member 22 such that the movable roller 9 is rotatable about the axis member 21. The roller-release lever 23 is connected at the left-hand end thereof to an axis member 27 such that the release lever 23 is pivotable about the axis member 27. A tension spring 25 is connected to the top of an intermediate portion of the release lever 23, for biasing the release lever 23 in an upward direction. Thus, the release lever 23 is held, at the right-hand end thereof, in engagement with a cam member 24 which is rotatable about an axis member 26 located above the release lever 23. The cam 24 serves as a stopper for stopping the upward pivotal motion of the release lever 23 caused by the biasing force of the tension spring 25. The cam 24 is rotated about the axis member 26 by a position-select drive motor 44 (FIG. 3) so as to permit the movable roller 9 to move upward, thereby placing the movable roller 9 in the above-described first position. In the first position, the movable roller 9 cooperates with the sheet heater 8, secured to a heater holder 28, to nip the recycle sheet 2 and thereby subject the recycle sheet 2 to the .heat generated by the sheet heater 8, while conveying the recycle sheet 2 forward because of the rotation of the roller 9 itself caused by a pulse motor 36 (FIG. 3).

There will be described the electric configuration of the printer 1 by reference to the control circuit thereof shown in FIG. 3.

The printer 1 includes a switch panel 41 which is operable by an operator for establishing various operating modes (communication mode, recording mode, etc.). The switch panel 41 includes a display (not shown) for indicating which mode has been selected on the printer 1 and/or other items such as what kind of abnormality has been occurred to the printer 1. When the operator selects an "ON-LINE" mode (i.e., "READY" mode) by operating the switch panel 41, the printer 1 is ready to receive data from an external device (not shown). The switch panel 41 additionally includes a ERASE/NON-ERASE mode-select switch 41*a* which the operator operates for selectively placing the printer 1 in an "ERASE" mode in which the image-erasing device 6 operates for erasing images recorded on a recycle sheet 2, and a "NON-ERASE" mode in which the image-erasing device 6 does not operate for the image erasing. Normally the operator will select the ERASE mode when imaged recycle sheets 2 each with images recorded thereon are accommodated in the sheet cassette 3, and will select the NON-ERASE mode when image-free recycle sheets 2 each with no image thereon are accommodated in the sheet cassette 3. It is possible to provide two sheet cassettes one of which is for holding imaged recycle sheets 2 and the other of which is for holding image-free recycle sheets 2. In this case, when the ERASE mode is selected, the imaged sheets 2 are taken out one by one from a corresponding one of the two cassettes, while when the NON-ERASE mode is selected, the image-free sheets 2 are taken out from the other cassette.

Each of the first and second sheet sensors 16, 29 supplies, upon detection of the top edge of a recycle sheet 2, the previously-described detection signal to a central processing unit (CPU) 32 which is described in detail below.

When the printer 1 receives printing data from the external device (not shown) via a communication line 30 and an interface 31, the CPU 32 transfers the received data to a random access memory (RAM) 33 according to instructions stored in a read only memory (ROM) 34. When the RAM 33 stores a predetermined amount of printing data, the CPU 32 generates a "BUSY" signal to the external device via the interface 31 and the communication line 30, thereby requesting the external device to temporarily stop supplying additional printing data to the printer 1. Meanwhile, the CPU 32 transmits the printing data from the RAM 33 to a head driver 40, and stores the data in a RAM (not shown) provided for the head driver 40. Subsequently, the CPU 32 commands the thermal head 13 to record images on the recycle sheet 2 according to the printing data stored in the RAM of the head driver 40, while at the same time controlling various drivers in such manners as described below.

One of the drivers controlled by the CPU 32 is a sheet-heater driver 38 which drives the sheet heater 8 for generating heat. A thermistor 39 is coupled to the sheet heater 8, for detecting the temperature of the heater 8, and supplies the CPU 32 with a detection signal indicative of the detected temperature of the heater 8.

Another driver controlled by the CPU 32 is a sheet feed/convey driver 35 which drives a pulse motor 36. When the pulse motor 36 is driven, the sheet-convey roller 5, movable roller 9, and/or platen 14 may be rotated. Additionally, through a solenoid-operated clutch 37, the sheet-feed roller 4 may be rotated.

A third driver controlled by the CPU 32 is a position-select driver 43 which drives a position-select drive motor 44. When the drive motor 44 is driven, the cam member 24 is selectively rotated in opposite directions so that the movable roller 9 is movable between the first position where the movable roller 9 contacts the sheet heater 8 to nip and heat a recycle sheet 2 and is rotated to convey the recycle sheet 2 forward, and the second position away from the heater 8 and where the roller 9 is not rotated.

The electric fan 15 is operated to cool a recycle sheet 2 when the ERASE mode is selected, but is not operated when the NON-ERASE mode is selected.

Hereinafter, there will be described the operation of the printer 1 constructed as described above.

In a first image-recording mode, i.e., "ERASE" mode, the printer 1 erases the images of an imaged recycle sheet 2 and subsequently records new images on the thus recycled sheet 2.

When an operator selects the ERASE mode by operating the ERASE/NON-ERASE mode-select switch 41*a* on the switch panel 41, the CPU 32 operates the sheet-heater driver 38. Based on the detection signal supplied from the thermistor 39, the CPU 32 drives the sheet heater 8 such that the temperature of the heater 8 is raised to an image-erasing temperature (e.g., about 150° C.). The images of an imaged recycle sheet 2 can be erased by heating to the image-erasing temperature and cooling from that temperature. When the sheet heater 8 reaches the image-erasing temperature, the CPU 32 starts one-page printing including the image erasing.

One-page printing starts with sheet feeding. The CPU 32 operates the sheet feed/convey driver 35 to drive the pulse motor 36. When the pulse motor 36 is driven, the drive force of the pulse motor 36 is transmitted via gear units (not shown) to the sheet-convey roller 5 and the movable roller 9. At the same time the drive force of the pulse motor 36 is transmitted to the solenoid-operated clutch 37. When the CPU 32 generates an "ON" signal to the solenoid clutch 37, the drive force of the pulse motor 36 is transmitted via the clutch 37 to the sheet-feed roller 4 so as to rotate the feed roller 4. Consequently the top one of the imaged recycle sheets 2 stacked in the sheet cassette 3 is taken out of the cassette 3 and fed over the first chute 7*a*, so that the imaged recycle sheet 2 is nipped by the sheet-convey roller 5 and a roller opposite to the convey roller 5.

Because of the rotation of the sheet-convey roller 5, the imaged recycle sheet 2 is conveyed forward. When the first sheet sensor 16 provided between the sheet-convey roller 5 and the image-erasing device 6 detects the top edge of the imaged recycle sheet 2, the sheet sensor 16 supplies the detection signal indicative of the detection of the recycle sheet 2, to the CPU 32. The CPU 32 generates, upon reception of the detection signal, an "OFF" signal to the solenoid-operated clutch 37, thereby stopping the rotation of the sheet-feed roller 4.

In the ERASE mode of the printer 1, the movable roller 9 is moved to the first position where the roller 9 contacts the sheet heater 8 controlled to the image-erasing temperature as described above. The imaged recycle sheet 2 is nipped between the sheet heater 8 and the movable roller 9 and, by the rotation of the movable roller 9, the recycle sheet 2 is conveyed forward. Since all portions or areas of the imaged recycle sheet 2 contact the sheet heater 8 held at the image-erasing temperature, the entire recycle sheet 2 is heated to that temperature, so that the recycle sheet 2 is brought into the state in which the images of the sheet 2 can be erased by cooling down from that temperature. After the recycle sheet 2 has passed through the image-erasing device 6, the sheet 2 is conveyed through the fourth and fifth chutes 10*a*, 10*b*. Since the rotation of the electric fan 15 has been started by the CPU 32 when the first sheet sensor 16 detects the recycle sheet 2, the sheet 2 is cooled down, while being conveyed through the chutes 10*a*, 10*b*, to a temperature lower than an image-developing temperature (e.g., about 60° C.) of the recycle sheets 2. New images can be recorded on the thus recycled sheet 2 by heating to the image-developing temperature. When the CPU 32 receives the detection signal from the second sheet sensor 29 indicative of the detection of the top edge of the recycled sheet 2, the CPU 32 stops the pulse motor 36 after having driven the pulse motor 36 by a prescribed amount of rotation. Thus, the position of the recycled sheet 2 relative to the thermal head 13 of the image-recording device 11 is established.

Subsequently, the CPU 32 operates the sheet feed/convey driver 35 by an appropriate amount, i.e., rotates the pulse motor 36 by an appropriate amount, so that the sheet-convey roller 5 and the platen 14 are rotated by the corresponding amount. In many cases this "appropriate amount" corresponds to the distance between two adjacent image lines to be printed on the recycle sheet 2. However, it may not be the case depending upon the printing data supplied. While the recycled sheet 2 is fed forward by an appropriate amount for each image line, the thermal head 13 thermally records images on selected areas of the recycle sheet 2 according to printing signals supplied from the head driver 40. In the ERASE mode, the recording head 13 is supplied with an electric current with 18 V to heat the printing areas of the sheet 2 to about 80° C. Since the stability of image-developing function of the recycle sheet 2 immediately after being heated by the image-erasing device 6 is relatively low even after the sheet 2 has been cooled to below the image-recording temperature (e.g., about 60° C.), the image recording is effected by applying a relatively high voltage to the thermal head 13, i.e., supplying a higher energy.

When the CPU 32 has operated for printing a prescribed number of image lines on the recycled sheet 2 after the second sheet sensor 29 has detected the bottom edge of the sheet 2, the CPU 32 judges that one-page image recording has been completed on the sheet 2, i.e., that printing of the sheet 2 has been finished, and immediately stops the printing operation. Subsequently, the CPU 32 operates the sheet feed/convey driver 35, i.e., drives the pulse motor 36 by an amount sufficient for outputting the printed sheet 2 into the output tray 12. Thus, one-page printing is completed. The output tray 12 serves as an outlet of the printer 1. While one-page printing is repeated using additional imaged recycle sheets 2 supplied from the sheet cassette 3, the printed sheets 2 are stacked on one another in the output tray 12.

Next, is described a second case where the printer 1 is operated for recording images on an image-free recycle sheet 2 without needing to effect image erasing before image recording, i.e., in the NON-ERASE mode.

When the operator operates the ERASE/NON-ERASE mode-select switch 41*a* for selecting the NON-ERASE mode on the printer 1, the CPU 32 identifies the selection of the NON-ERASE mode. In the NON-ERASE mode, the CPU 32 does not drive the sheet heater 8, and moves the movable roller 9 to the second position away from the heater 8. Therefore, upon reception of printing data, the CPU 32 immediately starts one-page printing including sheet feeding and conveying and image recording. In the NON-ERASE mode, however, the CPU 32 operates for applying an electric current with 15 V to the thermal head 13 so that appropriate areas of the image-free recycle sheet 2 is heated to about 60° C. lower than 80° C. for the ERASE mode in which the 18 V electric current is supplied to the thermal head 13. Since in the NON-ERASE mode the recycle sheet 2 is not heated by the image-erasing device 6, the stability of image-developing function of the sheet 2 is relatively high. Therefore, clear images are recorded on the sheet 2 with a lower printing energy.

In the NON-ERASE mode, the printer 1 carries out the other operations in the same manners as described above for the ERASE mode. No further description of those operations is made.

While in the present embodiment data receiving, sheet feeding and conveying, image recording, etc. are carried out in series to one another, it is possible to carry out some of those operations concurrently with one another by modifying the circuit configuration, control programs, etc., of the printer 1.

While in the present embodiment the constant voltage, 15 V, is supplied as the drive energy to the thermal head 13 when images are recorded on image-free recycle sheets 2, it is possible to adapt the CPU 32 to change the magnitude of the drive energy supplied to the thermal head 13 depending upon the current temperature of the sheet heater 8 detected by the thermistor 39 after the ERASE mode has been changed to the NON-ERASE mode.

Figure 4:
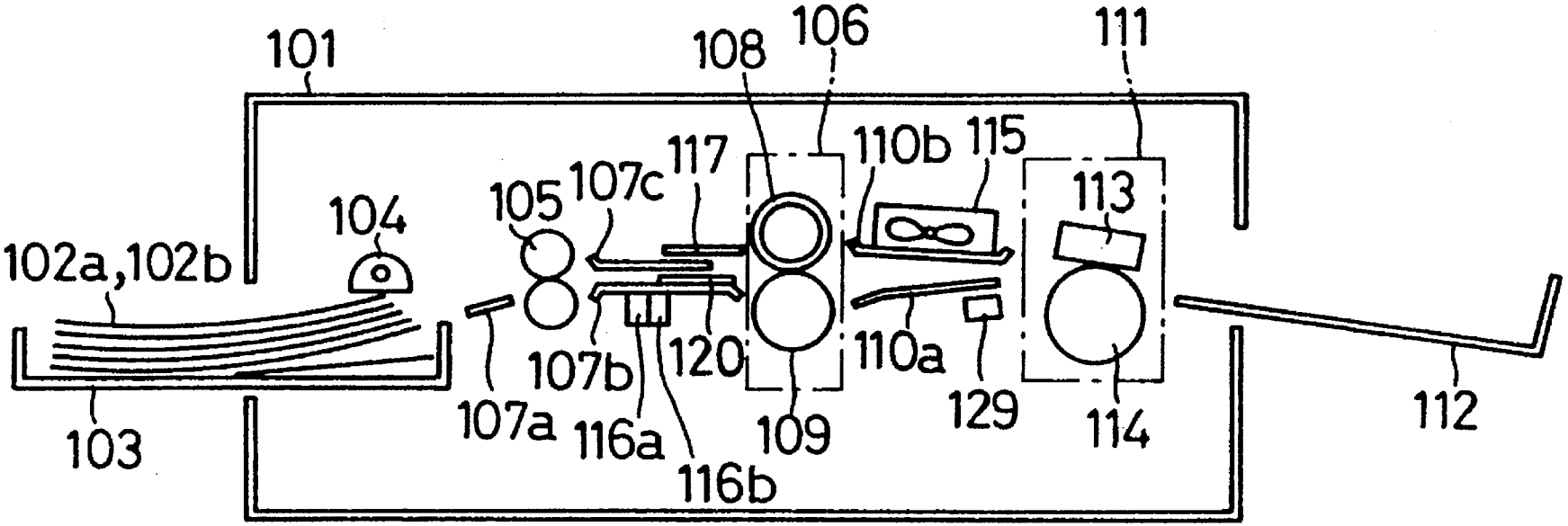
FIG. 4 is a diagrammatic view, corresponding to FIG. 1, of a recording apparatus as another embodiment of the present invention.

Referring next to FIG. 4, there is shown a printer 101 as a second embodiment of the present invention. FIG. 4 is a cross-sectional view showing general construction of the printer 101.

At the front-side portion (i.e., left-side portion as seen in FIG. 4) of the printer 101, there is provided a sheet cassette 103 in which are accommodated heat-sensitive image-recording cut sheets 102 including both recyclable sheets 102*a* (hereinafter, referred to as the "recycle sheets 102*a*") and unrecyclable sheets 102*b* (hereinafter, referred to as the "non-recycle sheets 102*b*"). The sheet cassette 103 is removable frontward or leftward from the printer 101. Above the right-hand end of the sheet cassette 103 being set in the printer 101, there is provided a generally semi-lunar sheet-feed roller 104 which is rotatable for taking out the top one of the recycle or non-recycle sheets 102*a*, 102*b* stacked in the cassette 103. Thus, the top sheet 102 may be either a recycle sheet 102*a* or a non-recycle sheet 102*b*. The sheet-feed roller 104 feeds, by rotation, the recycle or non-recycle sheet 102*a*, 102*b* toward a sheet-convey roller 105 which cooperates with a roller opposite thereto to convey forward the recycle or non-recycle sheet 102*a*, 102*b*. A first sheet chute 107*a* is provided between the feed roller 104 and the convey roller 105, and a second and a third sheet chute 107*b*, 107*c* are provided between the convey roller 105 and an image-erasing device 106 described later.

Figure 6:
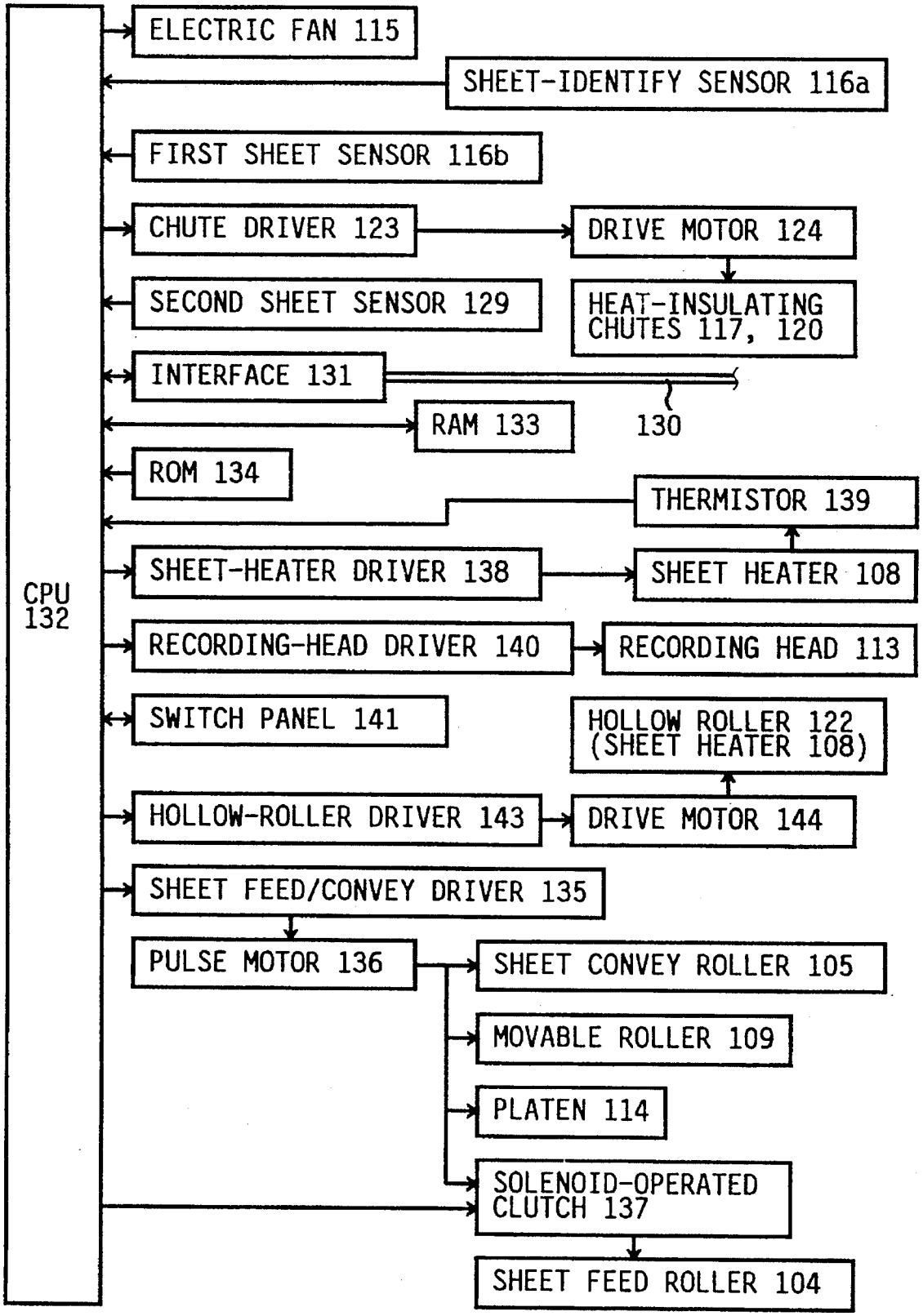
FIG. 6 is a block diagram of the electric circuit of the recording apparatus of FIG. 4.
Figure 7:
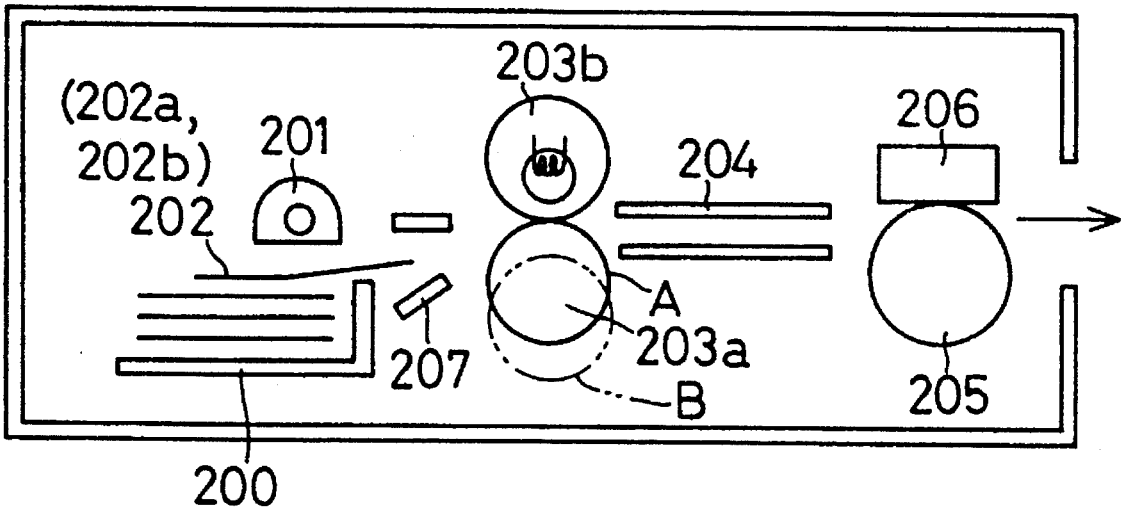
FIG. 7 PRIOR ART
FIG. 7 is a diagrammatic view, corresponding to FIGS. 1 and 4, of a proposed recording apparatus.

A sheet-identify sensor 116*a* is fixed to the lower surface of the second sheet chute 107*b*. The sheet-identify sensor 116*a* identifies whether a heat-sensitive sheet conveyed from the sheet-convey roller 105 is a recycle sheet 102*a* or a non-recycle sheet 102*b*, based on a difference between respective colors of the two sheets 102*a*, 102*b*, and generates an identify signal indicative of the result of the identification as shown in FIG. 6. A first sheet sensor 116*b* is also secured to the second sheet chute 107*b*. The first sheet sensor 116*b* detects the leading or top edge of the sheet 102*a*, 102*b* being conveyed from the sheet-convey roller 105, and generates a detection signal indicative of the detection of the recycle sheet 102 as shown in FIG. 6.

Heat-insulating shutters 117, 120 in the form of sheet chutes are provided over the second and third sheet chutes 107*b*, 107*c*, respectively, such that the heat-insulating shutters 117, 120 are movable as a unit, rightward and leftward, on the corresponding sheet chutes 107*b*, 107*c*. Thus, the heat-insulating shutters 117, 120 can serve as sheet chutes, i.e., sheet-guide members constituting a part of a path for conveying the sheet 102*a*, 102*b* forward in the printer 101.

Figure 5:
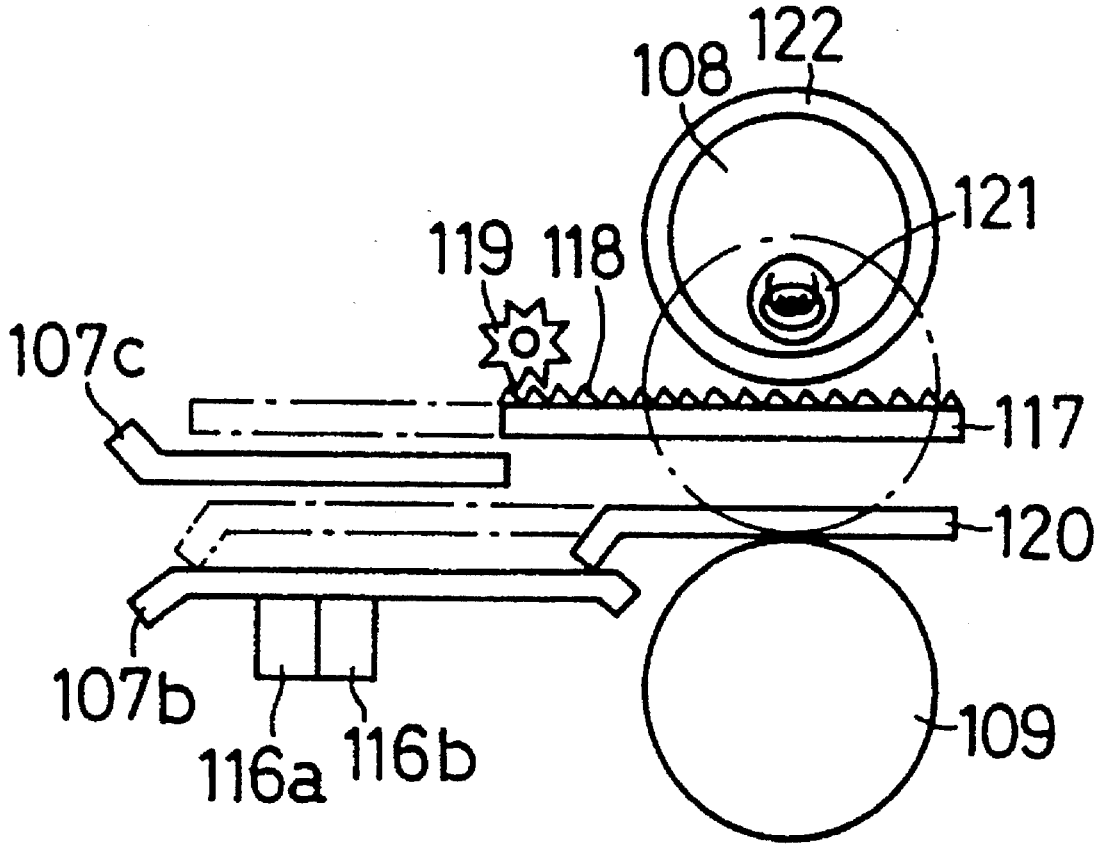
FIG. 5 is an illustrative view of the neighborhood of an image-erasing device of the recording apparatus of FIG. 4.

The image-erasing device 106 is located on the downstream or right-hand side of the second and third sheet chutes 107*a*, 107*b* as viewed in the direction of conveying of the recycle or non-recycle sheet 102*a*, 102*b*. The erasing device 106 includes a rubber-based roller 109 which is rotatable about a fixed axis line, and a sheet heater 108 located above the rubber roller 109. As shown in FIG. 5, the sheet heater 108 is movable between a first position indicated in phantom lines where the sheet heater 108 contacts the rubber roller 109 to nip and heat the recycle sheet 102*a*, and a second position indicated in solid lines where the sheet heater 108 is away from the rubber roller 109 and permits the non-recycle sheet 102*b* to pass through the image-erasing device 106 without being nipped or heated thereby. Even if the recycle sheet 102*a* is an imaged sheet having images recorded thereon, the images of the imaged recycle sheet 102*a* are erased by being heated by the sheet heater 108, so that the imaged sheet 102*a* is recycled to an image-free sheet 102*a*. Downstream of the erasing device 106, there are provided a fourth and a fifth sheet chute 110*a*, 110*b*, an image-recording unit 111, and an output tray 112 in the order of description. The image-recording unit 111 includes a thermal recording head 113, and a platen 114 located below the recording head 113. The thermal head 113 and the platen 114 cooperate with each other to thermally record images on the recycle or non-recycle sheet 102*a*, 102*b* the heat-insulating shutters 117, 120 and the image-recording unit 111 cooperate with each other to provide an image-recording device of the present printer 101".

A second sheet sensor 129 is fixed to the lower surface of the fourth sheet chute 110*a*. The second sheet sensor 129 detects the top edge of the recycle or non-recycle sheet 102*a*, 102*b* being conveyed, and generates a detection signal indicative of the detection of the sheet 102*a*, 102*b*. An electric fan 115 is disposed above the fifth sheet chute 110*b*. The electric fan 115 directs air toward the fifth chute 110*b*, thereby indirectly cooling the recycle sheet 102*a* which has been heated by the image-erasing device 106 or sheet heater 108.

FIG. 5 shows the neighborhood of the image-erasing device 106. The sheet heater 108 is constituted by a hollow cylindrical roller 122 which is rotatable about an axis line, and a halogen lamp 121 fixed inside the hollow roller 122. The hollow roller 122 is movable upward and downward by being driven by a position-select drive motor 144 (FIG. 6) and a cam member (not shown), so that only the hollow roller 122 is moved between the above-described first and second positions of the sheet heater 108. The halogen lamp 121 is immovable. The heat-insulating shutters or sheet chutes 117, 120 are slidable rightward and leftward on the second and third sheet chutes 107*a*, 107*b*, respectively, as described above. The upper heat-insulating shutter 117 is formed with a rack 118, and the rack 118 is in engagement with a pinion 119 connected to a chute drive motor 124 (FIG. 6). When the chute drive motor 124 is driven or rotated, the rotation of the drive motor 124 is transmitted to the heat-insulating shutters 117, 120 through the pinion 119 and the rack 118. In the event that the hollow roller 122 is moved upward to the second position of the sheet heater 108 away from the rubber roller 109, the heat-insulating shutters 117, 120 are moved from a first position thereof over the second and third sheet chutes 107*a*, 107*b* and away from the sheet heater 108 and the rubber roller 109, to a second position where the shutters 117, 120 are located between the hollow roller 122 (i.e., sheet heater 108) and the rubber roller 109. The heat-insulating shutters 117, 120 function, in the second position thereof, for preventing the heat generated from the hollow roller 120 or halogen lamp 121 from being transferred to the non-recycle sheet 102*b* and thereby adversely influencing the non-recycle sheet 102*b*. For example, the non-recycle sheet 102*b* may be "burned" due to that heat before images are recorded by the image-recording unit 111. Additionally, in the second position, the heat-insulating shutters 117, 120 function as sheet-guide members for conveying forward the non-recycle sheet 102*b* following the second and third sheet chutes 107*a*, 107*b*.

There will be described the operation of the printer 101 constructed as described above, by reference to the control circuit shown in FIG. 6.

The printer 101 includes a switch panel 141 which an operator uses for establishing various modes (communication mode, recording mode, etc.). The switch panel 141 includes a display (not shown) for indicating which mode has been established on the printer 101 and/or other items such as what kind of abnormality has been occurred to the printer 101. When the operator has selected an "ON-LINE" (i.e., "READY") mode through the switch panel 141, the printer 101 is ready to receive printing data from an external device (not shown). When the printer 101 receives printing data from the external device via a communication line 130 and an interface 131, a central processing unit (CPU) 132 transfers the received data to a random access memory (RAM) 133 according to instructions stored in a read only memory (ROM) 134. When the RAM 133 has stored a predetermined amount of printing data, the CPU 132 generates a "BUSY" signal to the external device via the interface 131 and the communication line 130, thereby requesting the external device to temporarily stop supplying additional data to the printer 101. Meanwhile, the CPU 132 transmits the printing data from the RAM 133 to a head driver 140, and stores the data in a RAM provided for the head driver 140. Subsequently, the CPU 132 commands the thermal recording head 113 to record images on the recycle or non-recycle sheet 102*a*, 102*b* according to the data stored in the RAM of the head driver 140, while at the same time controlling various drivers as described below.

Upon application of an electric power to the printer 101, the CPU 132 controls a sheet-heater driver 138 to drive the sheet heater 108 or halogen lamp 121. A thermistor 139 is coupled to the hollow roller 122 of the sheet heater 108, for detecting the temperature of the hollow roller 122, and supplies the CPU 132 with a detection signal indicative of the detected temperature of the roller 122. The CPU 132 raises the temperature of the hollow roller 122 to an image-erasing temperature (e.g., an about 150° C.) Even if a recycle sheet 102*a* has images recorded thereon, the images of the recycle sheet 102*a* can be erased by heating to the image-erasing temperature and subsequent cooling therefrom. When the hollow roller 122 is heated to the image-erasing temperature, the CPU 132 starts one-page printing.

One-page printing starts with sheet feeding. The CPU 132 operates a sheet feed/convey driver 135 to drive a pulse motor 136. When the pulse motor 136 is rotated, the rotation of the pulse motor 136 is transmitted via gear units (not shown) to the sheet-convey roller 105 and the rubber roller 109. At the same time the rotation of the pulse motor 136 is transmitted to a solenoid-operated clutch 137. When the CPU 132 generates an "ON" signal to the solenoid clutch 137, the rotation of the pulse motor 136 is transmitted via the clutch 137 to the sheet-feed roller 104 so as to rotate the feed roller 104. Consequently the top one of the recycle and non-recycle sheets 102 stacked in the sheet cassette 103 is taken out of the cassette 103 and fed onto the sheet chute 107*a*. The top sheet 102 may be a recycle sheet 102*a* or a non-recycle sheet 102*b*, as described above. Subsequently, the sheet 102 is nipped by the sheet-convey roller 105 and the roller opposite to the convey roller 105.

While the sheet 102 is conveyed forward by the rotation of the sheet-convey roller 105, the first sheet sensor 116*b* provided between the convey roller 105 and the image-erasing device 106 detects the top end of the sheet 102 being conveyed, and the sheet-identify sensor 116*a* identifies whether the detected sheet 102 is a recycle sheet 102*a* or a non-recycle sheet 102*b*. The first sheet sensor 116*b* supplies, to the CPU 132, the detection signal indicative of the detection of the sheet 102, and the sheet-identify sensor 116*a* supplies to the CPU 132 the identify signal indicative of the result of the above identification. The CPU 132 generates, upon reception of the detection signal from the first sheet sensor 116*b*, generates an "OFF" signal to the solenoid-operated clutch 137 to stop the rotation of the sheet-feed roller 104, and generates an "ON" signal to the electric fan 115 to activate the fan 115, upon reception of the identity signal indicating that the detected sheet 102 is a recycle sheet 102*a*.

In a first case where the sheet-identify sensor 116*a* identifies the detected sheet 102 as a recycle sheet 102*a*, the sheet heater 108 or hollow roller 122 controlled to the image-erasing temperature is moved to the first position where the hollow roller 122 contacts the rubber roller 109. The recycle sheet 102*a* conveyed through the second and third sheet chutes 107*a*, 107*b* is nipped by the sheet heater 108 and the rubber roller 109 and, by the rotation of the rubber roller 109, the recycle sheet 102*a* is conveyed forward. Since all portions or areas of the recycle sheet 102*a* continuously contact the sheet heater 108 controlled at the image-erasing temperature, the entire recycle sheet 102*a* is heated to that temperature, so that the recycle sheet 102*a* is brought into the state in which the images of the sheet 102*a* can be erased by cooling from that temperature. After the recycle sheet 102*a* is heated by the image-erasing device 106, the sheet 102*a* is conveyed through the fourth and fifth chutes 110*a*, 110*b*. Since the rotation of the electric fan 115 has been started by the CPU 132 when the sheet-identify sensor 116*a* identifies the recycle sheet 102*a*, the sheet 102*a* is cooled, while being conveyed through the sheet chutes 110*a*, 110*b*, down to a temperature lower than an image-developing temperature (e.g., about 60° C.) of both the recycle and non-recycle sheets 102*a*, 102*b*. Images can be recorded on the recycle or non-recycle sheet 102*a*, 102*b* by heating to the image-developing temperature. Thus, even if the recycle sheet 102*a* is an imaged sheet having images thereon, the imaged sheet 102*a* is recycled to a image-free sheet 102*a*.

On the other hand, in a second case where the sheet-identify sensor 116*a* identifies that the sheet 102 detected by the first sheet sensor 116*b* is a non-recycle sheet 102*b*, the CPU 132 operates a hollow-roller driver 143 and the drive motor 144 for moving the sheet heater 108 or hollow roller 122 to the second position away from the rubber roller 109, thereby separating the two members 108, 109 from each other. Subsequently, the CPU 132 operates a chute driver 123 to drive or rotate the drive motor 124 so that the heat-insulating shutters or sheet chutes 117, 120 are moved rightward as seen in FIG. 5 to provide a heat-barrier path which prevents the heat generated from the heater roller 108 from being transferred to the non-recycle sheet 102*b* conveyed therethrough.

When the CPU 132 receives the detection signal from the second sheet sensor 129 indicative of the detection of the top edge of the recycle or non-recycle sheet 102*a*, 102*b*, the CPU 132 stops the pulse motor 136 after having driven or rotated the pulse motor 136 by a prescribed amount. Thus, the position of the sheet 102*a*, 102*b* relative to the thermal recording head 113 of the image-recording device 111 is established.

The other steps carried out by the printer 101 for effecting one-page printing are the same as described above for the printer 1 of FIG. 1, and therefore description thereof is omitted.

As is apparent from the foregoing description, in the present or second embodiment, the sheet heater 108 of the image-erasing device 106 is moved away from the path of conveying of the non-recycle sheet 102*b* (and the recycle sheet 102*a*), and simultaneously the heat-insulating shutters 117, 120 are moved to the second position between the sheet heater 108 and the non-recycle sheet 102*b*, even when images are recorded on the sheet 102*b* immediately after images have been recorded on a recycle sheet 102*a* recycled by the image-erasing device 106. Thus, the heat-insulating shutters 117, 120 effectively prevent the non-recycle sheet 102*b* from adversely being influenced by the heat generated from the sheet heater 108. Therefore, images are recorded on a non-recycle sheet 102*b* immediately after recording of a recycle sheet 102*a*, with high recording quality and without needing any time for cooling the sheet heater 108. Consequently the overall printing time necessary for recording images on each of recycle and non-recycle sheets 102*a*, 102*b* mixed with each other is extremely shortened.

While in the present embodiment the heat-insulating shutters 117, 120 are moved toward the sheet heater 108 and rubber roller 109 for the purpose of isolating the non-recycle sheet 102*b* from the heat generated from those members 108, 109, it is possible to adapt the printer 101 to move the sheet heater and rubber roller 108, 109 toward the heat-insulating shutters 117, 120 fixed in a predetermined position for the same purpose.

Additionally, while in the second embodiment the sheet heater 108 is moved toward the stationary rubber roller 109 to nip the recycle sheet 102*a*, it is possible to adapt the printer 101 to move the rubber roller 109 toward the heater roller 108 for the same purpose. In this case, the sheet heater 108 may be a fixed member.

Like the printer 1 as the first embodiment, the printer 101 as the second embodiment may be adapted such that some of the steps such as data receiving, sheet feeding and conveying, and image recording are carried out concurrently with one another.

There will be described the third embodiment of the present invention. A printer as the third embodiment has generally the same construction as that of the printer 101 as the second embodiment. However, the instant printer is different from the printer 101 in that the former printer has a first, a second, and a third sheet cassette. The first sheet cassette is for accommodating imaged recycle sheets each with images thereon, the second sheet cassette is for accommodating image-free recycle sheets each with no image thereon, and the third sheet cassette is for accommodating image-free non-recycle sheets each with no image thereon. The instant printer does not have a sheet-identify sensor 116*a* but has an operator's mode-select switch for selecting one of a first, a second, and a third recording mode. The first recording mode is selected for erasing, using an image-erasing device 106, the images of an imaged recycle sheet supplied from the first sheet cassette and thereby recycling the imaged recycle sheet, and recording new images on the recycled sheet using the image-recording device including the image-recording unit 111 and the heat insulating shutters 117, 120. The second recording mode is selected for recording images on an image-free recycle sheet supplied from the second sheet cassette, and the third recording mode is selected for recording images on an image-free non-recycle sheet supplied from the third sheet cassette. In each of the second and third recording modes, the image-free recycle or non-recycle sheet is effectively protected by heat-insulating shutters 117, 120 from adversely being influenced by the heat generated by the image-erasing device 106, in the same manner as described above for the printer 101 as the second embodiment. In the instant printer, different drive energies, e.g., different electric voltages are supplied to a thermal head 113 of the image-recording unit 111 for effecting image recording in the first, second, and third recording modes, respectively. However, for each of the second and third recording modes, it is possible to supply a same or common drive energy to the thermal head 113 for the image recording.

While the present invention has been described in its preferred embodiments with detailed particulars, it is to be understood that the present invention is not limited to the detailed particulars of the illustrated embodiments but may be embodied with various changes, improvements, and modifications that may occur to those skilled in the art without departing from the scope and spirit of the invention defined in the appended claims.

What is claimed is:

1. A recording apparatus for recording images on a recyclable heat-sensitive sheet, comprising:

an image-erasing device which thermally erases images recorded on a first recyclable heat-sensitive sheet, thereby recycling said first sheet;

an image-recording device which thermally records images on each of (a) said first sheet which has been recycled by said image-erasing device and (b) a second recyclable heat-sensitive sheet which has not been recycled by said image-erasing device; and a control device which supplies a first energy to said image-recording device when the image-recording device records images on said first sheet recycled by said image-erasing device, and supplies a second energy different from said first energy to said image-recording device when the image-recording device records images on said second sheet.

2. A recording apparatus according to claim 1, wherein when said image-recording device records images on said first sheet recycled by said image-erasing device, said control device supplies said first energy higher than said second energy to the image-recording device.

3. A recording apparatus according to claim 1, wherein when said image-recording device records images on said first sheet recycled by said image-erasing device, said control device supplies a first electric volt as said first energy to the image-recording device, when said image-recording device records images on said second sheet, said control device supplies, as said second energy, a second electric volt lower than said first electric volt to the image-recording device.

4. A recording apparatus according to claim 1, wherein when said image-recording device records images on said first sheet recycled by said image-erasing device, said control device controls the image-recording device to heat appropriate areas of said first sheet to a first temperature and thereby record corresponding images on the first sheet, when said image-recording device records images on said second sheet, said control device controls the image-recording device to heat appropriate areas of said second sheet to a second temperature lower than said first temperature and thereby record corresponding images on the second sheet.

5. A recording apparatus according to claim 4, wherein said image-erasing device comprises a heat-generating member which heats all areas of said first sheet to a third temperature higher than said first temperature so as to erase the images recorded on the first sheet and thereby recycle the first sheet, and said image-recording device comprises a recording head which heats appropriate areas of each of said first and second sheets to record corresponding images on said each sheet.

6. A recording apparatus according to claim 5, wherein said image-recording device further comprises a cooling member which cools said first sheet to a fourth temperature lower than said first temperature after the first sheet has been heated to said third temperature by said heat-generating member and before the first sheet is heated to said first temperature by said recording head.

7. A recording apparatus according to claim 6, wherein said cooling member comprises an electric fan disposed between said heat-generating member and said recording head in a path for conveying forward each of said first and second sheets.

8. A recording apparatus according to claim 1, further comprising an operator's input device for selecting one of a plurality of recording modes including a first mode wherein said image-recording device records images on said first sheet recycled by said image-erasing device, and a second mode wherein said image-recording device records images on said second sheet.

9. A recording apparatus according to claim 1, wherein said image-erasing device comprises a heat-generating member and a nipper member which are movable relative to each other, when said image-recording device records images on said first sheet, said control device controls at least one of said heat-generating member and said nipper member to move relatively toward each other so as to nip said first sheet and thereby heat the first sheet, when said image-recording device records images on said second sheet, said control device controls at least one of said heat-generating member and said nipper member to move relatively away from each other so as to permit said second sheet to be conveyed forward without being nipped thereby.

10. A recording apparatus according to claim 9, wherein said nipper member comprises a sheet feed roller, said heat-generating member and said sheet feed roller being movable relatively toward each other so that the heat-generating member and the sheet feed roller nip said first sheet, the heat-generating member heats the first sheet, and the sheet feed roller feeds the first sheet forward.

11. A recording apparatus for recording images on a recyclable heat-sensitive sheet and an unrecyclable heat-sensitive sheet, comprising:

an image-erasing device which thermally erases images recorded on a recyclable heat-sensitive sheet, thereby recycling said recyclable sheet, said image-erasing device comprising a heat-generating member for heating said recyclable sheet;

an image-recording device which thermally records images on each of (a) said recyclable sheet which has been recycled by said image-erasing device and (b) an unrecyclable heat-sensitive sheet, said image-recording device comprising a heat-insulating member, said heat-generating and heat-insulating members taking a first relative-positional relationship wherein the heat-generating and heat-insulating members are positioned relatively away from each other so as to permit the heat-generating member to heat said recyclable sheet and thereby recycle the recyclable sheet, and a second relative-positional relationship wherein the heat-insulating member is positioned between the heat-generating member and said unrecyclable sheet so as to prevent the heat-generating member from heating the unrecyclable sheet; and a control device which controls at least one of said heat-generating and heat-insulating members to take said first relative-positional relationship when said image-recording device records images on said recyclable sheet recycled by said image-erasing device, and controls at least one of said heat-generating and heat-insulating members to take said second relative-positional relationship when said image-recording device records images on said unrecyclable sheet.

12. A recording apparatus according to claim 11, further comprising:

a sheet feeding device which feeds said recyclable sheet to said image-erasing device and subsequently to said image-recording device, and feeds said unrecyclable sheet to said image-recording device; and a sheet identifying device which identifies whether a heat-sensitive sheet fed by said sheet feeding device is said recyclable sheet or said unrecyclable sheet, when said sheet identifying device identifies that said heat-sensitive sheet fed by said sheet feeding device is said recyclable sheet, said control device controls at least one of said heat-generating and heat-insulating members to take said first relative-positional relationship, when said sheet identifying device identifies that said heat-sensitive sheet fed by said sheet feeding device is said unrecyclable sheet, said control device controls at least one of said heat-generating and heat-insulating members to take said second relative-positional relationship.

13. A recording apparatus according to claim 11, wherein said image-erasing device comprises a heat-generating member and a nipper member which are movable relative to each other, when said image-recording device records images on said recyclable sheet, said control device controls at least one of said heat-generating member and said nipper member such that the two members move relatively toward each other to nip said recyclable sheet and thereby heat the recyclable sheet, when said image-recording device records images on said unrecyclable sheet, said control device controls at least one of said heat-generating member and said nipper member such that the two members move relatively away from each other to permit said unrecyclable sheet to be conveyed forward without being nipped thereby.

14. A recording apparatus according to claim 13, wherein said heat-insulating member comprises at least one sheet-guide member which is movable, according to said first relative-positional relationship, to a first position where said sheet-guide member permits said heat-generating member and said nipper member to move relatively toward each other so as to nip said recyclable sheet and thereby heat the recyclable sheet, and is movable, according to said second relative-positional relationship, to a second position where said sheet-guide member is positioned between said heat-generating member and said nipper member which currently are relatively positioned away from each other, so as to prevent the heat-generating member from heating said unrecyclable sheet and simultaneously provide a path for conveying the unrecyclable sheet forward.

15. A recording system according to claim 13, wherein said heat-generating member comprises a hollow roller and a heater element provided inside said hollow roller, and said nipper member comprises a sheet feed roller, said hollow roller and said sheet feed roller being movable relatively toward each other so that the two rollers nip said recyclable sheet, said heater element indirectly heats the recyclable sheet via the hollow roller, and the sheet feed roller feeds the recyclable sheet forward.

16. A recording apparatus for recording images on a heat-sensitive sheet, comprising:

an image-erasing device which thermally erases images recorded on a recyclable heat-sensitive sheet, thereby recycling said recyclable sheet, said image-erasing device comprising a heat-generating member for heating said recyclable sheet;

an image-recording device which thermally records images on each of (a) said recyclable sheet which has been recycled by said image-erasing device and (b) an image-free heat-sensitive sheet which does not need the image erasing by said image-erasing device, said image-recording device comprising a heat-insulating member, said heat-generating and heat-insulating members taking a first relative-positional relationship wherein the heat-generating member and heat-insulating members are positioned relatively away from each other so as to permit the heat-generating member to heat said recyclable sheet and thereby recycle the recyclable sheet, and a second relative-positional relationship wherein the heat-insulating member is positioned between the heat-generating member and said image-free sheet so as to prevent the heat-generating member from heating the image-free sheet; and a control device which, when said image-recording device records images on said recyclable sheet recycled by said image-erasing device, controls at least one of said heat-generating and heat-insulating members to take said first relative-positional relationship and simultaneously supplies a first energy to said image-recording device and, when said image-recording device records images on said image-free sheet, controls at least one of said heat-generating and heat-insulating members to take said second relative-positional relationship and simultaneously supplies a second energy different from said first energy to said image-recording device.

17. A recording system according to claim 16, wherein said image-recording device thermally records images on said image-free sheet as a recyclable heat-sensitive sheet which has not been recycled by said image-erasing device.

18. A recording system according to claim 16, wherein said image-recording device thermally records images on said image-free sheet as an unrecyclable heat-sensitive sheet.

19. A recording apparatus for recording images on a heat-sensitive sheet, comprising:

an image-erasing device which thermally erases images recorded on a first heat-sensitive sheet which is a recyclable heat-sensitive sheet, thereby recycling said first sheet;

an image-recording device which thermally records images on each of (a) said first sheet which has been recycled by said image-erasing device and (b) at least one of (b1) a second heat-sensitive sheet which is a recyclable heat-sensitive sheet and which has not been recycled by said image-erasing device and (b2) a third heat-sensitive sheet which is an unrecyclable heat-sensitive sheet; and a control device which controls said image-recording device according to a first recording condition when the image-recording device records images on said first sheet recycled by said image-erasing device, controls said image-recording device according to a second recording condition different from said first recording condition when the image-recording device records images on said second sheet, and controls said image-recording device according to a third recording condition different from said first recording condition when the image-recording device records images on said third sheet.

20. A recording apparatus according to claim 19, wherein when said image-recording device records images on each of said second and third sheets, said control device controls the image-recording device according to a common recording condition as said second and third recording conditions different from said first recording condition.

21. A recording apparatus according to claim 19, wherein when said image-recording device records images on said first sheet recycled by said image-erasing device, said control device supplies a first energy to the image-recording device according to said first recording condition, when said image-recording device records images on said second sheet, said control device supplies a second energy different from said first energy to the image-recording device according to said second recording condition, when said image-recording device records images on said third sheet, said control device supplies a third energy different from said first energy to the image-recording device according to said third recording condition.

22. A recording apparatus according to claim 21, wherein said image-erasing device comprises a heat-generating member for heating said first sheet, when said image-recording device records images on said second sheet, said control device determines a drive energy as said second energy based on a temperature of said heat-generating member, and supplies the determined drive energy to the image-recording device, when said image-recording device records images on said third sheet, said control device determines a drive energy as said third energy based on a temperature of said heat-generating member, and supplies the determined drive energy to the image-recording device.

23. A recording apparatus according to claim 19, wherein said image-erasing device comprises a heat-generating member for heating said first sheet, and said image-recording device comprises a heat-insulating member, said heat-generating and heat-insulating members taking a first relative-positional relationship wherein the heat-generating and heat-insulating members are positioned relatively away from each other so as to permit the heat-generating member to heat said first sheet and thereby recycle the first sheet, and a second relative-positional relationship wherein the heat-insulating member is positioned between the heat-generating member and each of said at least one of said second and third sheets so as to prevent the heat-generating member from heating said each of said at least one of said second and third sheets, when said image-recording device records images on said first sheet recycled by said image-erasing device, said control device controls, according to said first recording condition, at least one of said heat-generating and heat-insulating members to take said first relative-positional relationship, when said image-recording device records images on said each of said at least one of said second and third sheets, said control device controls, according to a corresponding one of said second and third recording conditions, at least one of said heat-generating and heat-insulating members to take said second relative-positional relationship.

* * * * *